US006698514B2

(12) United States Patent
Norris et al.

(10) Patent No.: US 6,698,514 B2
(45) Date of Patent: Mar. 2, 2004

(54) REMOTE OPERATED COIL CONNECTOR APPARATUS

(75) Inventors: Robert M. Norris, Dorset (GB); Brent Marsh, Bournemouth (GB)

(73) Assignee: Varco I/P, Inc., Houston, TX (US)

( * ) Notice: Subject to any disclaimer, the term of this patent is extended or adjusted under 35 U.S.C. 154(b) by 16 days.

(21) Appl. No.: 10/136,362

(22) Filed: May 2, 2002

(65) Prior Publication Data

US 2003/0205372 A1 Nov. 6, 2003

(51) Int. Cl.[7] ..... E21B 19/16
(52) U.S. Cl. ..... 166/242.6; 166/77.2
(58) Field of Search ..... 166/380, 65.1, 166/242.6, 242.7, 77.2

(56) References Cited

U.S. PATENT DOCUMENTS

| | | | | |
|---|---|---|---|---|
| 3,850,250 A | | 11/1974 | Holden et al. | 166/315 |
| 4,113,012 A | | 9/1978 | Evans et al. | 166/264 |
| 5,609,178 A | | 3/1997 | Hennig et al. | 137/10 |
| 6,209,652 B1 | | 4/2001 | Portman et al. | |
| 6,450,541 B1 | * | 9/2002 | Bakke | 285/2 |
| 2001/0030048 A1 | * | 10/2001 | Mackenzie et al. | 166/380 |
| 2003/0102132 A1 | * | 6/2003 | Estep et al. | 166/377 |

FOREIGN PATENT DOCUMENTS

| | | | |
|---|---|---|---|
| EP | 0 939 193 | 9/1999 | E21B/21/10 |
| GB | 2 268 770 | 1/1994 | E21B/21/10 |
| WO | WO 01/06086 | 1/2001 | E21B/21/10 |

OTHER PUBLICATIONS

PCT International Search Report from International Application No. PCT/GB02/01966, dated Jul. 19, 2002.

* cited by examiner

*Primary Examiner*—William Neuder
(74) *Attorney, Agent, or Firm*—Finnegan, Henderson, Farabow, Garrett & Dunner LLP

(57) ABSTRACT

A remote operated coil connector apparatus for use with coiled tubing in a well bore. The apparatus has upper and lower mechanical and electrical connectors. These connectors are adapted for remote operation with respect to a tool holder that secures a tool string within a well bore.

11 Claims, 4 Drawing Sheets

REMOTE OPERATED COIL CONNECTOR APPARATUS

DESCRIPTION OF THE INVENTION

BACKGROUND OF THE INVENTION

The invention relates to a remote operated coil connector apparatus for use with coiled tubing in a well bore.

The use of coiled tubing as a device for well intervention applications is well known. The use of coiled tubing permits the insertion and withdrawal from a well bore of both mechanical and hydraulic tooling. It is also applicable to the use of electronic devices in the well bore that require an electrical conductor extending from the device to surface facilities. Since various operations are required to be performed in the well bore, which in turn require various tool strings, it is necessary to, in coiled tubing operations, change the tool to accommodate the desired function. This operation is performed manually. For extreme and remote operations, however, such as sub-sea or hazardous operations, manual selection and changing of the tools required is not practical or efficient.

It is accordingly an object of the present invention to provide a coil connector apparatus that may be remotely operated from the standpoint of connecting and disconnecting tool strings to accommodate various well bore operations.

SUMMARY OF THE INVENTION

In accordance with the invention, there is provided a remote operated coil connector apparatus for use with coiled tubing in a well bore. The apparatus comprises a coiled tubing connector having at one end thereof connector means for mechanical connection to coiled tubing and at an opposite end thereof a second connector means. There is further provided an upper assembly having at one end thereof connector means for mechanical connection to the second connector means of the coiled tubing connector and said coiled tubing, and at an opposite end thereof second mechanical connector means and electrical connection means. There is further provided a lower assembly having at one end thereof connector means for mechanical connection to the mechanical connection means of the upper assembly and electrical connection means for electrical connection to the electrical connection means of the upper assembly. The lower assembly is also provided at an opposite end thereof second connector means for mechanical connection. Further, there is a tool holder having connection means at an upper end thereof for mechanical connection to the second connector means of the lower assembly and at a lower end thereof means for securing the tool holder to a tool string within the well bore.

The apparatus may further include said upper assembly and said lower assembly having means for remotely selectively connecting and disconnecting the second mechanical connector means and electrical connector means thereof.

The upper assembly and the lower assembly may have a sealed through passage for fluid to pass through the apparatus.

The means for remotely selectively connecting the second mechanical connector means of the upper assembly and the lower assembly may include a latching connector. This latching connector may include a plurality of spring-loaded latch keys located in the upper assembly for latching into a receptacle in the lower assembly.

The electrical connector means of the upper assembly and lower assembly may include a male-half electrical connector in the upper assembly and a mating female-half electrical connector in the lower assembly.

The latched keys of the upper assembly may be adapted to contact a reduced diameter portion of the tool holder resulting from movement of the tool string upwardly to compress the latch keys out of engagement with the receptacles to disconnect the upper assembly from the lower assembly.

The latch keys of the lower assembly may engage with a corresponding profile within the tool holder to hold the tool string in place within the tool holder.

The latch keys of the upper assembly may be operated to contact a reduced diameter portion of the tool holder resulting from movement of the tool string downwardly to compress the latch keys out of engagement with the receptacle to disconnect the tool string from the tool holder and into the well bore.

DETAILED DESCRIPTION OF THE PREFERRED EMBODIMENTS

Figure 1:
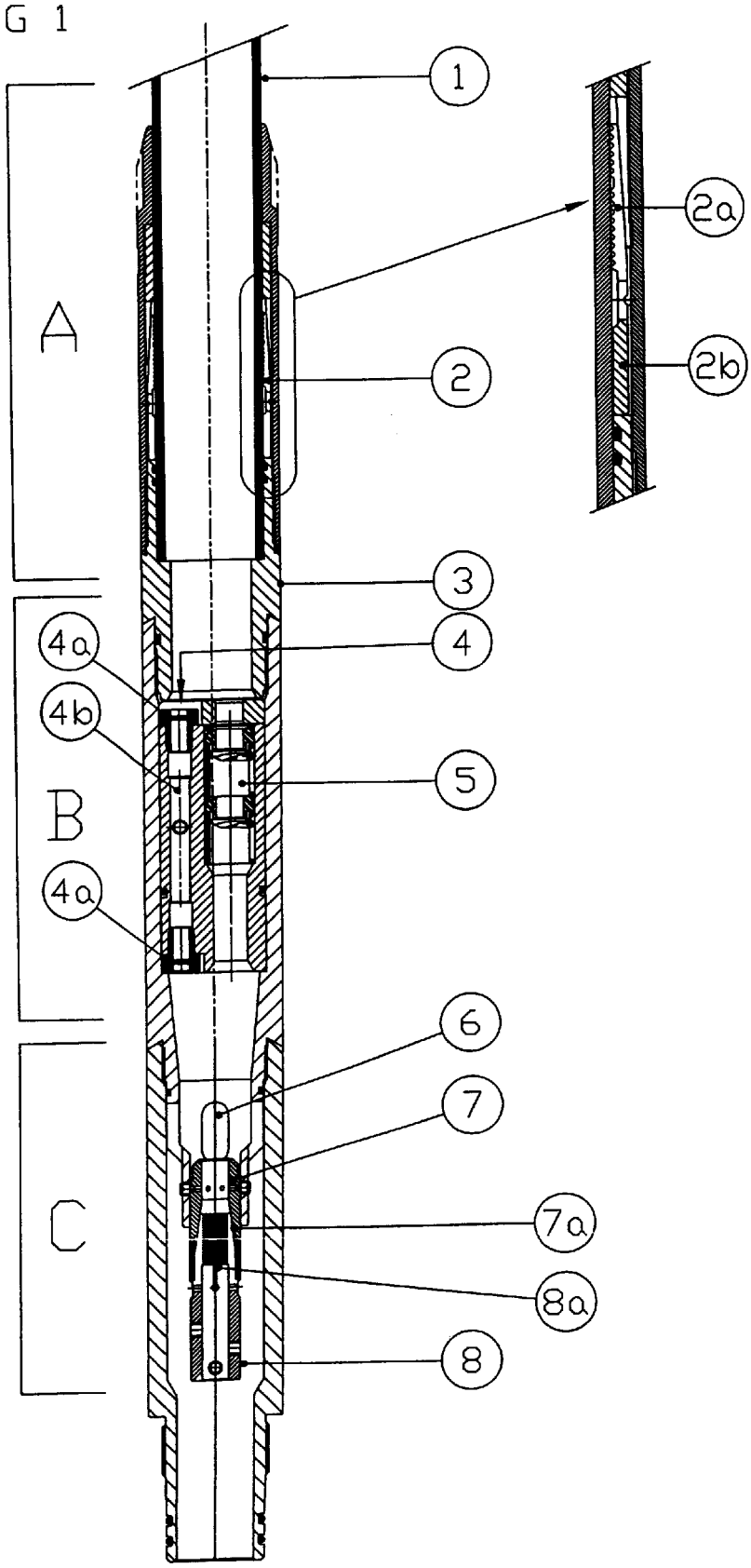
FIG. 1 is a sectional view of one embodiment of a coil connector for use with the remote operated coil connector apparatus of the invention.

With respect to FIG. 1, the coiled tubing 1 is shown with a coiled tubing connector having helical serrated slips 2 that grip the coiled tubing by a wedging action. Thus, an increase in tension between the tool string (not shown) and coiled tubing 1 results in an increased grip by the helical serrated slips. The slips are designed with two opposed handed sets of helical serrations 2*a* and tangs 2*b* that key the slip to the bottom sub 3 to provide torque resistance.

A twin flapper check valve 5 with cable bypass 4 prevents the backflow of well fluids into the coil in the event of failure or damage of the coiled tubing string or surface equipment. A bypassing cable (not shown) is packed off with dual rubber elements 4*a* for forming a cavity 4*b* which is pumped with grease to form a liquid seal around the cable. The valve 5 provides a fluid flow path through the lower tool string sufficient to feed jetting/simulation fluids and operate tools and hydraulic manipulation tools to the well bore.

Figure 2:
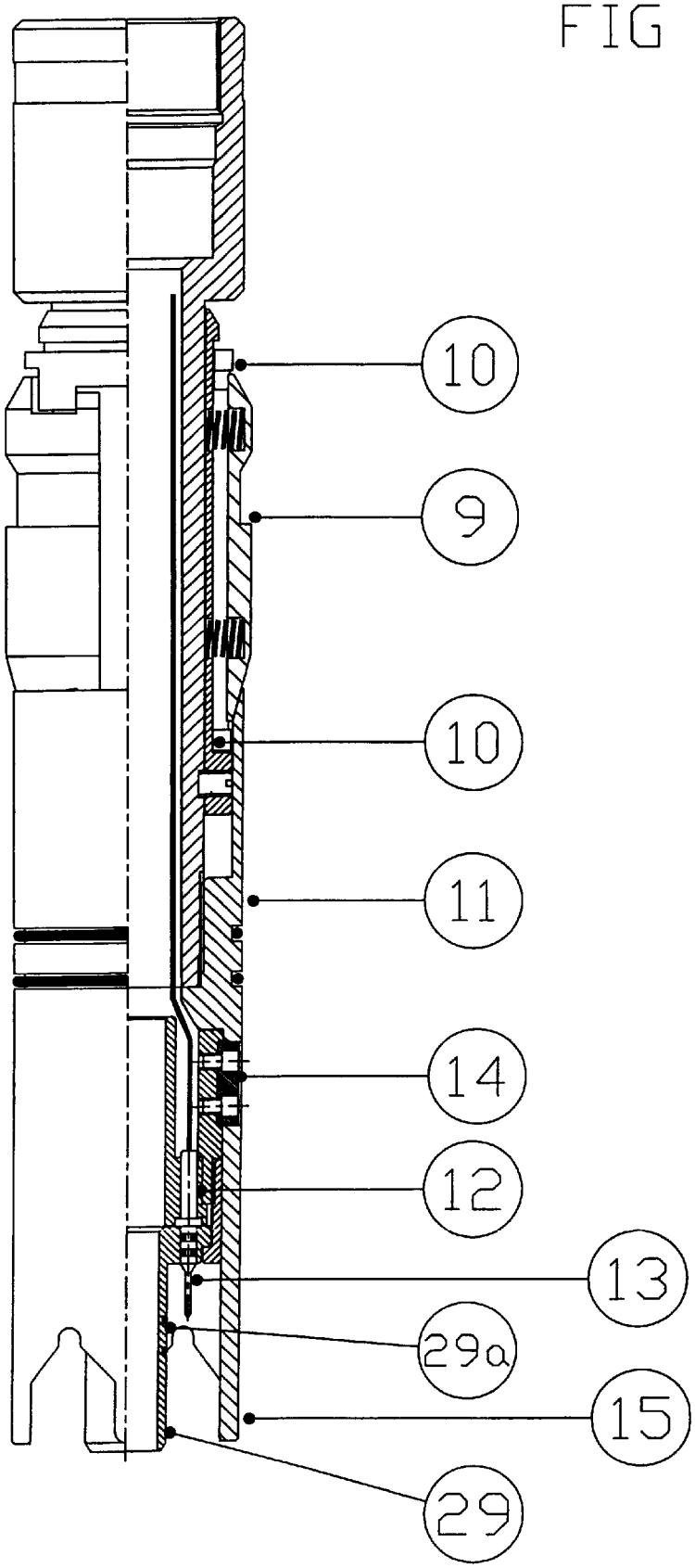
FIG. 2 is a sectional view of one embodiment of an upper assembly of the apparatus.

A cable anchor 8 is provided in fluted housing 6 to permit fluid flow below the valve 5. It comprises a retainer 7 with an internal taper and housing 7*a* that has a matching tapered collet 8*a* with internal serrated teeth (not shown). The retainer 7 is fed over the cable followed by the housing 7*a*. Thus, by screwing the retainer 7 into the housing 7*a* the serrated teeth are forced to grip the cable to provide a stable anchor point. Depending upon the type of cable used, the cable outer and inner armor may then be cut back flush to the ends of the cable anchor 8 to expose the insulated The upper assembly shown in FIG. 2 comprises a series of spring-loaded latch keys 9 designed to locate and latch into a receptacle 16 in the lower assembly of FIG. 3. The keys 9 are retained externally by retainer rings 10 attached to the body of the upper assembly. Once the keys 9 are latched into the receptacle in the lower assembly, a joint is formed which can only be released by extraneous means provided by the tool holder which will be later described.

Internally, the lower body 11 of the upper assembly houses a bulkhead carrier 12 for a single or multiple electrical pressure resistant connectors 13. The coiled tubing cable-core conductors may be connected to these connectors. The bulk head carrier 12 when mated with the lower assembly provides a chamber that is pressure resistant to the well and to internal coiled tubing fluid. The bulkhead carrier 12 is oriented to the body 11 by an integral key 14. The upper and lower assemblies are aligned by a cam profile 15. This is shown as a multi-profile cam, but may be a single cam depending upon the application. The cam profile is self-aligning as the upper and lower assemblies are pushed together. This ensures correct alignment for the connectors 13 in order to form a sealed electrical connection. The male fluid union 29 of the upper assembly with external seals 29*a* will be engaged into the seal receptacle 30 provided in the lower assembly, as shown in FIG. 3, to provide a continuous, pressure containing through passage.

Figure 3:
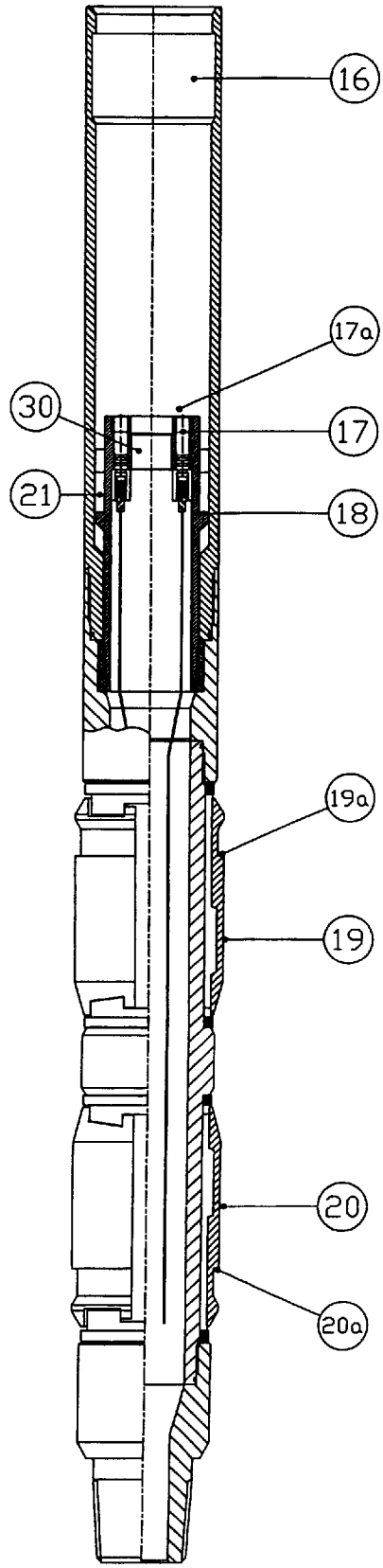
FIG. 3 is a sectional view of an embodiment of the lower assembly of the apparatus.

With reference to FIG. 3, the lower assembly comprises a latch receptacle 16 to receive the keys 9 of the upper assembly. Once the keys 9 of the upper assembly are latched into this receptacle 16, a connection is formed which can only be released by extraneous means provided by the tool holder, which will be later described.

Internally, the latch receptacle 16 houses a bulkhead carrier 18, which houses a multiple of electrical connectors 17 to match the male connectors 13 of the upper assembly. The bulk head carrier 18 is free to rotate radially. It has a single or series of cam profiles 21 designed to align with the mating profiles 15 in the upper assembly, prior to forming the electrical connection. The cam profiles 21 are therefore self-aligning as the upper and lower assemblies are pushed together. The bulkhead carrier 18, when mated with the upper assembly, provides a chamber 17*a* that is pressure resistant to the well and to internal coiled tubing fluid.

Figure 4:
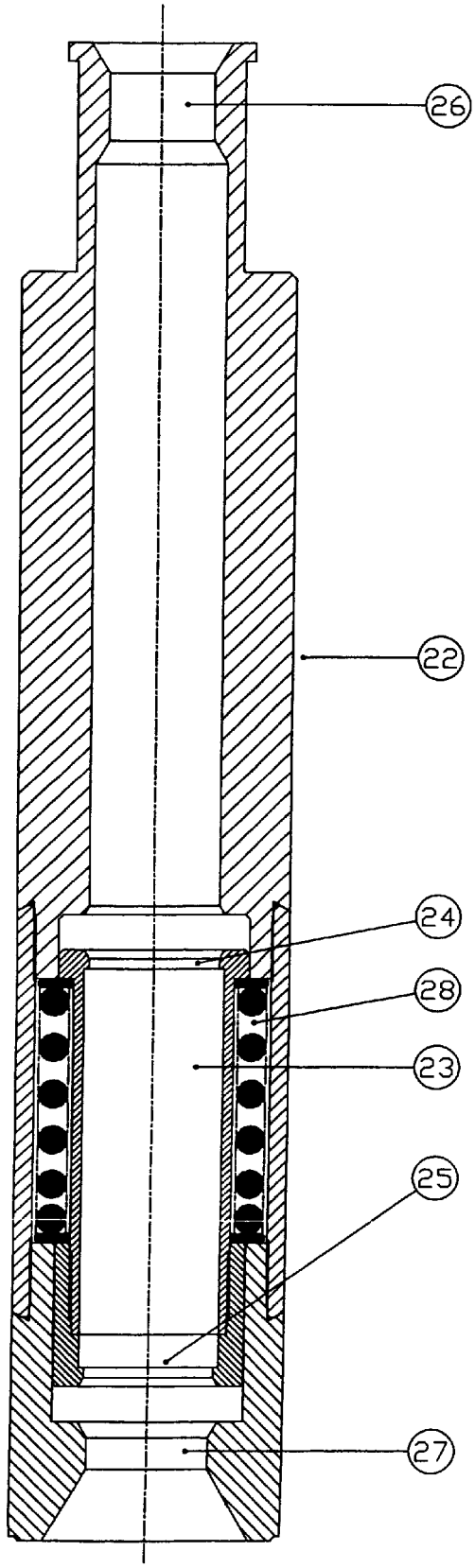
FIG. 4 is a sectional view of an embodiment of a tool holder for use with the apparatus.

Externally, a series of spring-loaded downward-facing anchor keys 20 are positioned to provide a positive, downward load-bearing seat 20*a* against a mating shoulder 25 housed within the tool holder shown in FIG. 4. This structure is capable of holding up the hanging weight of the tool string.

Similarly, a set of upwardly facing anchor keys 19 are positioned to provide a positive, upward load-bearing seat (19A) against a mating shoulder 24 housed within the tool holder of FIG. 4, thereby acting as a positive stop for the location of the tool string. The shoulder 24 will also enable an over-pull to be taken through the coiled tubing once the upper assembly has been connected to the lower assembly.

The tool holder shown in FIG. 4 is incorporated into the apparatus in accordance with the invention to provide an interface between the handling equipment and the upper and lower assemblies. Within the handling equipment, a multiple of tool strings can be housed in carousels (not shown) ready for use, and can be selected at the well head as desired to accommodate the intervention operation. The main requirement of the tool holder is to provide the tool string, within each carousel, with a holding mechanism that is compatible with the upper and lower assemblies of the remote operated coil connector apparatus.

As shown in FIG. 4, housed within the body 22 of the tool holder is a spring-loaded catcher sleeve 23. Spring 28 of the catcher sleeve 23 is pre-loaded to a set force. At each end of the internal diameter of the catcher sleeve 23, square load-bearing shoulders 24 and 25 are formed into which the anchor keys 19 and of the lower assembly will respectively locate.

When the upper assembly is connected to the lower assembly, an upward overpull with the coiled tubing is required to confirm that the joint is positively latched. This is achieved by picking up the tool string, through the load-bearing shoulders 24 of the catcher sleeve 23, so that the pre-loaded spring 28 compresses.

If the tool string is pulled beyond a certain force limit, the latch keys of the upper assembly will contact a reduced neck 26 in the upper body of the tool holder, at which point, the latch keys will be compressed and released from the lower assembly latch receptacles.

Similarly, after confirming that the joint between the upper and lower assemblies is positively latched so that the tool string may be inserted into the well, the upper and lower assembly is pushed down by the coiled tubing against the lower load-bearing shoulder 25 of the catcher sleeve 23 so that the pre-loaded spring 28

If the tool string is pushed beyond a certain predetermined force, the anchor keys of the lower assembly will contact a reduced neck 27 in the lower body of the tool holder at which point the anchor keys will be compressed and released from the catcher sleeves. This disconnects the tool string from the tool holder and allows the coil string to be deployed into the well for the required operation.

When the operation is completed, the tool string is returned to the tool holder, the lower assembly will locate into the catcher sleeve 23, whereupon and over-pull/push with the coiled tubing will confirm that the tool string is positively located. The upper assembly joint can then be released by over-pulling as previously described, leaving the lower assembly with the tool string in place in the tool holder and separated from the upper assembly.

What is claimed is:

1. A remote operated coil connector apparatus for use with coiled tubing in a well bore, said apparatus comprising:

a coiled tubing connector having at one end thereof connector means for mechanical connection to coiled tubing and at an opposite end thereof a second connector means;

an upper assembly having at one end thereof connector means for mechanical connection to said second connector means of said coiled tubing connector and said coiled tubing, and at an opposite end thereof second mechanical connector means and electrical connection means;

a lower assembly having at one end thereof connector means for mechanical connection to said mechanical connector means of said upper assembly and electrical connection means for electrical connection to said electrical connection means of said upper assembly, and at an opposite end thereof second connector means for mechanical connection;

a tool holder having connector means at an upper end thereof for mechanical connection to said second connector means of said lower assembly and at a lower end thereof means for securing said tool holder to a tool string within the well bore.

2. The apparatus of claim 1, wherein said upper assembly and said lower assembly have means for remotely selectively connecting and disconnecting the second mechanical connector means and electrical connector means thereof.

3. The apparatus of claim 2, wherein said upper assembly and said lower assembly have a sealed through passage for fluid to pass through the apparatus.

4. The apparatus of claim 3, wherein said means for remotely selectively connecting the second mechanical connector means of said upper assembly and said lower assembly includes a latching connector.

5. The apparatus of claim 4, wherein said latching connector includes a plurality of spring-loaded latch keys located in said upper assembly for latching into a receptacle in said lower assembly.

6. The apparatus of claim 5, wherein said electrical connector means of said upper assembly and said lower assembly includes an electrical connection in said upper assembly and a mating electrical connection in said lower assembly.

7. The apparatus of claim 6, wherein said latching connector of said lower assembly engages with a corresponding profile within said tool holder to hold the tool string in place within the tool holder.

8. The apparatus of claim 7, wherein said latch keys of said upper assembly are adapted to contact a reduced diameter portion of said tool holder resulting from movement of said tool string upwardly to compress said latch keys out of engagement with said receptacles to disconnect said upper assembly from said lower.

9. The apparatus of claim 8, wherein said latch keys of said upper assembly are adapted to contact a reduced diameter portion of said tool holder resulting from movement of said tool string downwardly to compress said latch keys out of engagement with said receptacle to disconnect the tool string from the tool holder and into the well bore.

10. A remote operated coil connector apparatus for use with coiled tubing in a well bore, said apparatus comprising:

a coiled tubing connector having at one end thereof connector means for mechanical connection to coiled tubing and at an opposite end thereof a second connector means;

an upper assembly having at one end thereof connector means for mechanical connection to said connector means of said coiled tubing connector and said coiled tubing, and at an opposite end thereof second mechanical connector means and electrical connection means;

a lower assembly having at one end thereof connector means for mechanical connection to said mechanical connector means of said upper assembly and electrical connection means for electrical connection to said electrical connection means of said upper assembly, and at an opposite end thereof second connector means for mechanical connection;

said means for remotely selectively connecting said second mechanical connector means of said upper assembly and said lower assembly includes a latching connector; and a tool holder having connector means at an upper end thereof for mechanical connection to said second connector means of said lower assembly and at a lower end thereof means for securing said tool holder to a tool string within the well bore.

11. The apparatus of claim 10, wherein said electrical connector means of said upper assembly and said lower assembly includes an electrical connection in said upper assembly and a mating electrical connector in said lower assembly.

* * * * *

UNITED STATES PATENT AND TRADEMARK OFFICE

CERTIFICATE OF CORRECTION

PATENT NO. : 6,698,514 B2
DATED : March 2, 2004
INVENTOR(S) : Robert Norris and Brent Marsh It is certified that error appears in the above-identified patent and that said Letters Patent is hereby corrected as shown below:

Column 5,
Line 23, "lower" should read -- lower assembly --.

Signed and Sealed this

Fifteenth Day of June, 2004

JON W. DUDAS
*Acting Director of the United States Patent and Trademark Office*